US009436139B2

(12) United States Patent
Kadowaki

(10) Patent No.: US 9,436,139 B2
(45) Date of Patent: Sep. 6, 2016

(54) IMAGE HEATING APPARATUS

(71) Applicant: CANON KABUSHIKI KAISHA, Tokyo (JP)

(72) Inventor: Hiroyuki Kadowaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/463,957

(22) Filed: Aug. 20, 2014

(65) Prior Publication Data

US 2015/0055968 A1 Feb. 26, 2015

(30) Foreign Application Priority Data

Aug. 21, 2013 (JP) ..... 2013-171154

(51) Int. Cl.
*G03G 15/20* (2006.01)

(52) U.S. Cl.
CPC ..... *G03G 15/2039* (2013.01); *G03G 15/205* (2013.01); *G03G 15/2042* (2013.01); *G03G 15/2078* (2013.01)

(58) Field of Classification Search
CPC ..... G03G 15/2039; G03G 15/2042; G03G 15/2046; G03G 15/2078; G03G 15/2082
USPC ..... 399/69, 328, 329, 330, 335; 219/216
See application file for complete search history.

(56) References Cited

U.S. PATENT DOCUMENTS 8,068,758 B2 11/2011 Kaji
8,218,993 B2 7/2012 Kaji
8,331,819 B2 * 12/2012 Fukuzawa et al. ..... 399/69
2003/0215255 A1 * 11/2003 Kinouchi et al. ..... 399/69
2009/0196643 A1 * 8/2009 Mito et al. ..... 399/69
2009/0297204 A1 12/2009 Kaji
2012/0014706 A1 1/2012 Kaji
2014/0321873 A1 10/2014 Kadowaki et al.

FOREIGN PATENT DOCUMENTS

JP 08220932 A * 8/1996
JP 10-177319 A 6/1998
JP 2001109322 A * 4/2001
JP 2002072726 A * 3/2002
JP 2006126565 A * 5/2006
JP 2009-075443 A 4/2009
JP 2009-139778 A 6/2009
JP 2009-288275 A 12/2009
JP 2012154995 A * 8/2012

* cited by examiner

*Primary Examiner* — Robert Beatty
(74) *Attorney, Agent, or Firm* — Fitzpatrick, Cella, Harper & Scinto

(57) ABSTRACT

An image heating apparatus includes: a rotatable member; and a first heater and a second heater, for heating the rotatable member. The ratio of the second-heater heat generation amount at an end portion thereof to that at a central portion thereof is larger than that of the first heater at an end portion thereof to that at a central portion thereof with respect to the longitudinal direction. The apparatus also includes: a back-up member; a sensor; and an electric power supply controller capable of controlling the heaters independently. The controller effects switching to decrease the ratio of the power to the second heater to the power to the first heater, when heating a small width sheet. Immediately after the switching, the power to the second heater is smaller and the power to the first heater is larger than those immediately before the switching.

13 Claims, 10 Drawing Sheets

IMAGE HEATING APPARATUS

FIELD OF THE INVENTION AND RELATED ART

The present invention relates to an image heating apparatus (device) with which an image forming apparatus such as an electrophotographic copying machine, an electrophotographic printer, and the like, is equipped.

There have been known various image heating apparatuses (devices) which are mountable as a fixing device in an image forming apparatus such as a copying machine, a laser beam printer, and the like. One of them is an image heating apparatus (device) which employs a heating film, and is known to virtually instantly startup. Generally speaking, it is made up of a ceramic heater (as heat source), a fixation film, and a pressure roller. The pressure roller is pressed against the ceramic heater, with the presence of the fixation film between the pressure roller and ceramic heater, forming thereby a nip between itself and heater. In operation, the film is circularly driven in contact with the heater and pressure roller. While the fixation film is circularly driven, a sheet of recording medium on which an unfixed toner image is present is conveyed through this nip, while being subjected to heat and pressure. Consequently, the unfixed toner image on the sheet of recording medium becomes thermally fixed to the sheet.

A fixing device such as the above described one which employs a heating film (fixation film) has been know to suffer from the problem that in a case where a substantial number of small sheets of recording medium, that is, sheets of recording medium which are narrower than the heat generation range of the heater of the fixing device, are continuously conveyed for fixation through its fixation nip, the portions of the ceramic heater, fixation film pressure roller, etc., which are outside the path of the small sheets of recording medium, are likely to unnecessarily increase in temperature.

Thus, there have been proposed various fixing apparatuses (devices) capable of dealing with the above-described problem. One of them is disclosed in Japanese Laid-open Patent Application H10-177319. It is structured so that when a substantial number of prints of a small size are continuously outputted, the portions of the heater, which are outside the sheet path, are reduced in the amount of heat generation, compared to the portion of the heater, which are within the sheet path. More specifically, the fixing device is provided with a heater and a heater driving circuit. The heater has multiple heat generating resistors which are different in heat generation pattern in terms of the direction (lengthwise direction) perpendicular to the recording medium conveyance direction. The multiple heat generating resistors are disposed in parallel in the recording medium conveyance direction. Further, the heater driving circuit is enabled to control in duty the power supply to each heat generating resistor, in order to control each heat generation resistor in such a manner that, they are changed in the gradient of their heat generation pattern, in terms of the lengthwise direction, according to the size of a sheet of recording medium used for image formation.

More concretely, when a large sheet of recording medium is used for image formation, both the duty of the power supply to the first heat generating resistor 610, and that of the power supply to the second heat generating resistor 620 are set to 40% (200 W in heat generation amount). On the other hand, when a small sheet of recording medium is used for image formation, the duty of the power supply to the first heat generating resistor 610 is set to 50% (250 W in power generation amount), and the duty of the power supply to the second heat generating resistor 620 is set to 20% (100 W in heat generation amount).

SUMMARY OF THE INVENTION

According to an aspect of the present invention, there is provided an image heating apparatus for heating a recording material having a toner image formed thereon while feeding the recording material, in a nip, said apparatus comprising:

a rotatable member;

a first heat generating element and a second heat generating element, for heating said rotatable member, said heat generating elements being elongated in a generatrix direction of said rotatable member, wherein a ratio of a heat generation amount of said second heat generating element at a end portion thereof to that at a central portion thereof with respect to the generatrix direction is larger than a ratio of a heat generation amount of said second heat generating element at a end portion thereof to that at a central portion thereof with respect to the generatrix direction;

a back-up member contacting said rotatable member to form the nip;

a temperature detecting portion, and a controller for controlling an electric power supplied to said first heat generating element and said second heat generating element in accordance with a detected temperature acquired by said temperature detecting portion, said controller being capable of controlling the electric power to said first heat generating element and the electric power to said second heat generating element, independently from each other;

wherein said controller effects switching to decrease a ratio of the electric power to said second heat generating element to the electric power to said first heat generating element, when said apparatus heats a recording material having a width smaller than a maximum width usable with said apparatus, and wherein immediately after the switching by said controller, the electric power to said second heat generating element is smaller and the electric power to said first heat generating element is larger than immediately before the switching.

According to another aspect of the present invention, there is provided an image heating apparatus for heating a recording material having a toner image formed thereon while feeding the recording material, in a nip, said apparatus comprising:

a rotatable member;

a first heat generating element and a second heat generating element, for heating said rotatable member, said heat generating elements being elongated in a generatrix direction of said rotatable member, wherein a ratio of a heat generation amount of said second heat generating element at a end portion thereof to that at a central portion thereof with respect to the generatrix direction is larger than a ratio of a heat generation amount of said second heat generating element at a end portion thereof to that at a central portion thereof with respect to the generatrix direction;

a back-up member contacting said rotatable member to form the nip;

a temperature detecting portion for detecting a temperature of said rotatable member or said heat generating element; and a controller for controlling electric power supplied to said heat generating element so that a detected temperature of said temperature detecting portion is at a target temperature, said controller being capable of controlling the electric power to said first heat generating element and the electric power to said second heat generating element, independently from each other;

wherein said controller effects switching to decrease a ratio of the electric power to said second heat generating element to the electric power to said first heat generating element, when said apparatus heats a recording material having a width smaller than a maximum width usable with said apparatus, and wherein said controller effects the control so that a sum of the electric power supplied to said first heat generating element and the electric power supplied to said second heat generating element immediately before the switching is the same as the sum immediately after the switching.

According to a further aspect of the present invention, there is provided an image heating apparatus for heating a recording material having a toner image formed thereon while feeding the recording material, in a nip, said apparatus comprising:

a rotatable member;

a first heat generating element and a second heat generating element, for heating said rotatable member, said heat generating elements being elongated in a generatrix direction of said rotatable member, wherein a ratio of a heat generation amount of said second heat generating element at a end portion thereof to that at a central portion thereof with respect to the generatrix direction is larger than a ratio of a heat generation amount of said second heat generating element at a end portion thereof to that at a central portion thereof with respect to the generatrix direction;

a back-up member contacting said rotatable member to form the nip;

a temperature detecting portion, and a controller for controlling an electric power supply duty cycle which is electric power supply time per unit time to said heat generating element, on the basis of a detected temperature of said temperature detecting portion, said controller being capable of controlling the duty cycle for said first heat generating element and the duty cycle for said second heat generating element, independently from each other, wherein said controller effects switching to decrease a ratio of the electric power supply duty cycle to said second heat generating element to the electric power supply duty cycle to said first heat generating element, when said apparatus heats a recording material having a width smaller than a maximum width usable with said apparatus, and Further features of the present invention will become apparent from the following description of exemplary embodiments (with reference to the attached drawings).

DESCRIPTION OF THE PREFERRED EMBODIMENTS

<<Embodiment 1>>

Hereinafter, some of the preferred embodiments of the present invention are described in detail with reference to appended drawings. However, the measurements, materials, and shapes of the structural components of the apparatuses and devices in the following embodiments of the present invention, and the positional relationship among the structural components, are not intended to limit the present invention in scope. That is, they are to be modified as necessary according to the structure of the apparatuses and devices to which the present invention is applied, and also, according to various conditions under which the apparatus and devices are used.

(Image Forming Apparatus)

Figure 1:
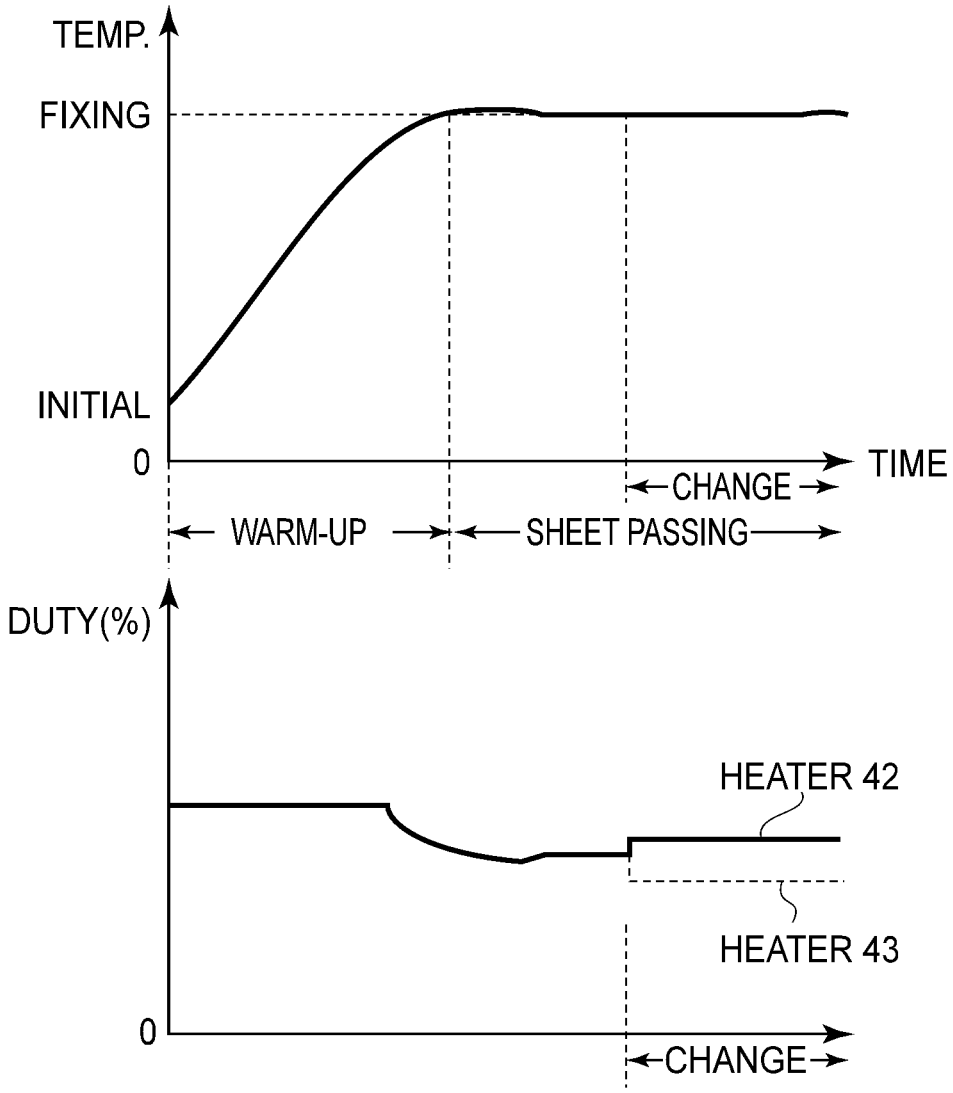
FIG. 1 is a drawing which shows the temperature of the fixation heater before and after the power supply to the fixation heater was switched in duty to control in temperature the fixation heater of the image heating device in the first embodiment of the present invention.
Figure 2:
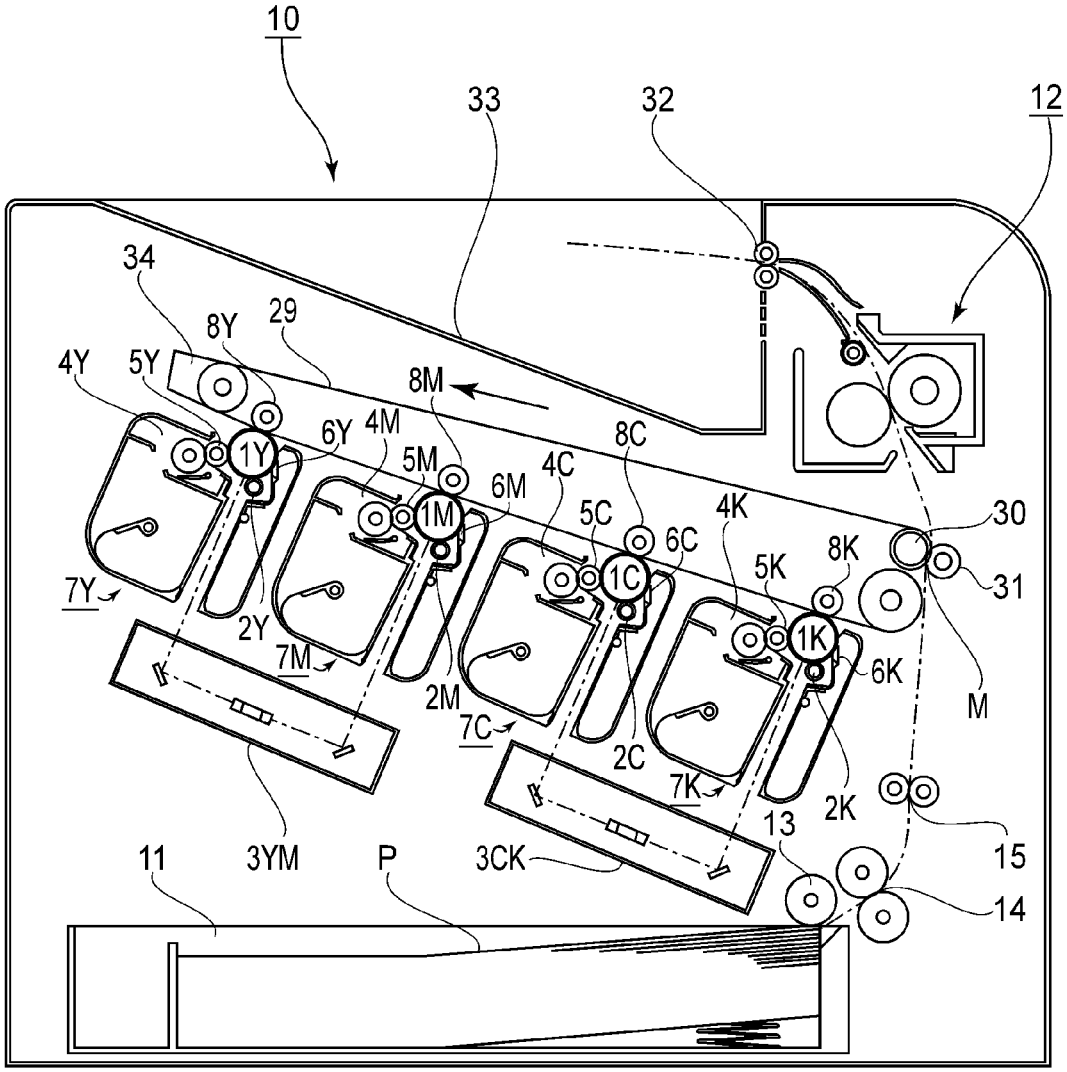
FIG. 2 is a schematic sectional view of the image forming apparatus equipped with the image heating apparatus in the first embodiment of the present invention, and shows the structure of the image forming apparatus.

First, referring to FIG. 2, the image forming apparatus equipped with a fixing device (as image heating device) which is in accordance with the present invention is described about its overall structure. FIG. 2 is a schematic sectional view of a full-color printer (which hereafter will be referred to simply as printer 10), which is an example of an image forming apparatus to which the present invention is applicable. It shows the overall structure of the apparatus. Incidentally, the image forming apparatus in this embodiment is a full-color printer having multiple photosensitive drums. However, this embodiment is not intended to limit the present invention in terms of the number of photosensitive drums. That is, the present invention is also applicable to a monochromatic copying machine, a monochromatic printer, and the like, which is equipped with only one photosensitive drum.

The printer 10 has a cassette 11, which is in the bottom portion of the printer. The cassette 11 can be pulled out of the printer. It can store in layers a substantial number of sheets of recording medium. The sheets of recording medium in the cassette 11 are pulled out of the cassette 11 by a pickup roller 13 while being separated by a pair of rollers 14 (feed roller and retard rollers). Then, each sheet is conveyed to a pair of registration rollers 15. The printer 10 is also provided with an image forming portion 7, as an image forming means, having image formation stations 7Y, 7M, 7C and 7K which are for yellow, magenta, cyan and black colors, respectively, and which are aligned parallel in tandem in the recording medium conveyance direction.

The image forming portion 7 has: photosensitive drums 1Y, 1M, 1C and 1K (which hereafter will be referred to together simply as photosensitive drum 1); charging device 2Y, 2M, 2C and 2K for uniformly charging the peripheral surface of the photosensitive drum 1; and developing devices 4Y, 4M, 4C and 4K. There are development rollers 5Y, 5M, 5C and 5K in the developing devices 4Y, 4M, 4C and 4K, respectively, The development rollers 5 are for adhering toner to the electrostatic latent image on the photosensitive drum 1 to develop the toner image.

The image forming portion 7 has also primary transfer portion 8Y, 8M, 8C and 8K (which hereafter will be referred to together as primary transfer portion 8), which transfer the toner image on the photosensitive drum 1 onto an electrostatic transfer belt 29. Further, the image forming portion 7 has cleaning blades 6Y, 6M, 6C and 6K which remove the toner which has failed to be transferred in the primary transfer portion 8, being therefore remaining on the photosensitive drum 1 after the primary transfer. The printer 10 is provided with scanner units 3YM and 3CK, which is on the bottom side of the image forming portion 7. The scanner units 3YM and 3CK project a beam of laser light while modulating the beam according to the information of the image to be formed, in order to form an electrostatic latent image on the peripheral surface of the photosensitive drum 1.

After the transfer of the toner image onto the transfer belt 29, in the primary transfer portion 8, the toner image on the transfer belt 29 is transferred by a secondary transfer roller 31 onto a sheet P of recording medium, in the secondary transfer portion M formed by a belt-backing roller 30 and the secondary transfer roller 31. The secondary transfer residual toner, that is, the toner having failed to be transferred onto the sheet P of recording medium, in the secondary transfer portion M, and therefore remaining on the transfer belt 29, is removed and recovered by a belt cleaning device 34. After being conveyed through the secondary transfer portion M, the sheet P is conveyed through a fixing device 12, in which the toner image is fixed to the surface of the sheet P.

After the fixation of the toner image to the sheet P of recording medium, the sheet P is conveyed to a pair of discharge rollers 32. Then, the sheet P is discharged by the pair of discharge roller 33, through the interface between the pair of discharge roller, into a delivery tray, in a manner to be accumulated therein. Incidentally, in terms of the direction (which hereafter may be referred to simply as lengthwise direction) perpendicular to the recording medium conveyance direction, the widths of the widest and narrowest sheets of recording medium conveyable through the printer 10 in this embodiment are 297 mm and 76 mm, respectively. Also in terms of the lengthwise direction, the point of reference for positioning a sheet of recording medium, relative to the printer, is roughly the center of the printer (central reference).

(Image Heating Apparatus (Device))

Figure 3:
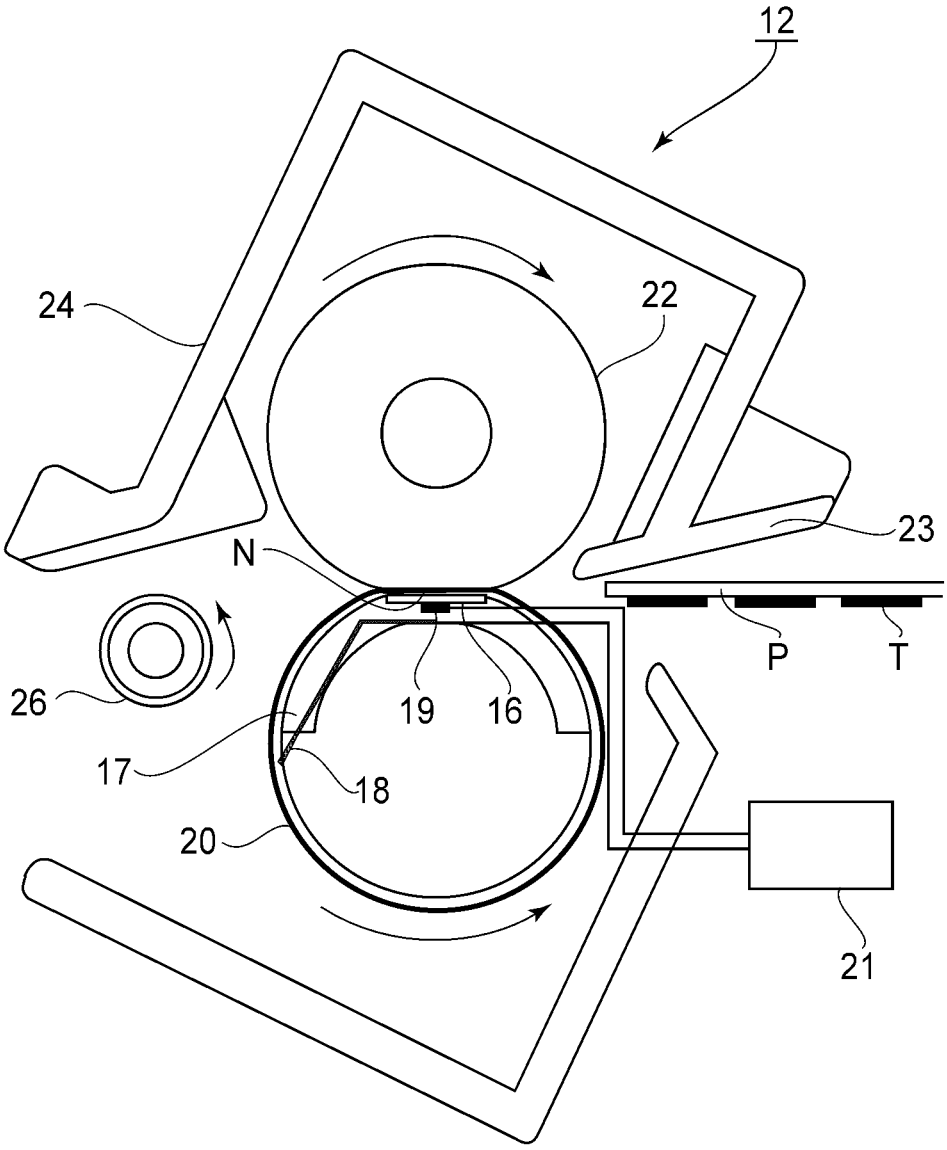
FIG. 3 is a schematic sectional view of the fixing device (as image heating apparatus) in the first embodiment, and shows the structure of the fixing device.

Next, referring to FIG. 3, the fixing device 12, as an image heating apparatus in accordance with the present invention, is described. The fixing device 12 in this embodiment is of the so-called heating film type, and also, of the so-called tensionless type (heating film is driven by pressure roller which presses heating film).

1) Overall Structure 1-a) Heat Source (Heater)

A referential numeral 16 stands for a fixation heater as a heat source (heat generating member), which is made up of a substrate and heat generating resistors. The substrate is formed of ceramic or the like substance. The heat generating resistors are formed on the substrate. The fixation heater 16 generates heat as it is supplied with electric power by a heater driving circuit 21, which will be described later. The details of the heater will be described later.

1-b) Heater Holder

A referential code 17 stands for a heater holder as a supporting member. It is roughly semicircular in cross-section. The heater holder 17 is made of highly heat resistant liquid polymer. It supports the heater 16, and guides the fixation sleeve 20 by the inward surface of the fixation sleeve 20. The liquid polymer used as the material for the heater holder 17 is Sumikasuper E5204L (commercial name) produced by Sumitomo Chemical Co., Ltd. The heater 16 is supported by the heater seating portion of the heater holder 17, in such a manner that its long edges become parallel to the long edges of the heater holder 17. The fixation sleeve 20 is loosely fitted around the combination of the heater 16 and heater holder 17, making up a fixation sleeve unit.

1-c) Temperature Detecting Portion (Thermistor) and Heater Driving Circuit

A referential code 18 stands for a thermistor for detecting the temperature of the fixation sleeve 20, which will be described later. In this embodiment, the thermistor 18 is disposed so that its temperature detecting portion contacts the inward surface of the fixation sleeve 20. The temperature information of the fixation sleeve 20 is transmitted to the heater driving circuit 21. The thermistor 19 is for detecting the temperature of the heater 16. In this embodiment, the image heating device 12 is provided with two thermistors 19, which are disposed on the opposite surface of the heater 16 from the fixation sleeve 20. In terms of the lengthwise direction, one of the thermistors 19 is at the center of the heater 16, and the other is at one of the end portions of the heater 16.

In terms of the lengthwise direction, the thermistor 19*a* (FIG. 6) is at the center of the heater 16, whereas the thermistor 19*b* (FIG. 6) is at one of the lengthwise ends of the heater 16. It is disposed so that it is within the path of the largest sheet (size SRA3, which is 320 mm in width) of recording medium conveyable through the fixing device 12, and on the outward side of the path of the smallest sheet (size LTR, which is 279 mm in landscape attitude) of recording medium conveyable through the fixing device 12. The temperature information of the heater 16 is transmitted to the heater driving circuit 21.

A referential code 21 stands for the heater driving circuit, which controls the amount by which electric power is supplied to the heater 16 to control the amount by which the heater 16 generates heat. Basically, it keeps the temperature of the heater 16 or fixation sleeve 20 at a preset level, by controlling the amount by which electric power is supplied to the heater 16, based on the temperature information transmitted thereto from the thermistors 18 and 19. The heater driving circuit 21 is described later in detail.

1-d) Rotational Heating Member

A referential code 20 stands for the fixation sleeve (fixation film) as a rotational heating member. It is a cylindrical component (endless belt) made up of a cylindrical substrate, an elastic layer, and a surface layer. More specifically, the substrate is a cylindrical metallic endless belt, which is 24 mm in internal diameter, and 30 μm in thickness. It is made of stainless steel or the like. The elastic layer is made of silicone rubber, and covers the outward surface of the substrate. It is roughly 300 μm in thickness. The surface layer covers the elastic layer. It is a piece of PFA resin tube. It is 30 μm in thickness. Regarding the external shape of the fixation sleeve 20, the fixation sleeve 20 in this embodiment is uniform in external diameter. However, the shape of the fixation sleeve 20 may be such that its cross-section, at a plane which coincides with its axial line, is in the form of an inverted crown, that is, its center portion is different in external diameter from its lengthwise end portions.

1-e) Pressure Bearing Member (Belt-backing Member) and Pressure Application Mechanism A referential code 22 stands for a pressure roller as a pressure bearing member (belt-backing member). The pressure roller 22 is made up of a metallic core, an elastic layer, and a piece of PFA resin tube. The metallic core is made of stainless steel. The elastic layer is formed of silicone rubber, by injection molding, in a manner to cover the peripheral surface of the metallic core. It is roughly 3 mm in thickness. The PFA resin tube is roughly 40 μm in thickness. It covers the silicone rubber layer. The pressure roller 22 in this embodiment is 25 mm in external diameter. It is rotatably supported by the unshown rear and front lateral plates of the frame of the fixing device 12. More specifically, the lengthwise ends of the metallic core are rotatably supported by a pair of bearings attached to the rear and front lateral plates, one for one.

The above-described fixation sleeve unit is on the bottom side of the pressure roller 22, being positioned in parallel to the pressure roller 22, with its heater side facing upward. It is kept pressured toward the axial line of the pressure roller 22 by the pressure (147 N (15 kgf) per lengthwise end; 294 N (30 kgf) in total) applied to the lengthwise ends of the heater holder 17 by an unshown pressure application mechanism. Thus, the upwardly facing surface of the heater 16 is pressed by the application of a preset amount of pressure, against the pressure roller 22, with the presence of the fixation sleeve 20 between the heater 16 and pressure roller 22, while being subjected to the resiliency of the elastic layer of the pressure roller 22. Consequently, a fixation nip N with a preset width, which is necessary for thermal fixation, is formed.

The pressure roller 22 is rotationally driven by an unshown driving means at a preset peripheral velocity in the clockwise direction indicated by an arrow mark. Thus, the cylindrical fixation sleeve 20 is subjected to the rotational friction generated between the peripheral surface of the pressure roller 22 and fixation sleeve 20, in the fixation nip N, by the rotation of the pressure roller 22. Thus, the fixation sleeve 20 is rotated by the rotation of the pressure roller 22 in the counterclockwise direction indicated by another arrow mark, around the heater holder 17, with its inward surface sliding on (while remaining in contact with) the upwardly facing surface of the heater 16. The inward surface of the fixation sleeve 20 is coated with grease to minimize the friction between the heater holder 17 and the inward surface of the fixation sleeve 20.

1-f) Recording Medium Conveyance through Nip

It is after the fixation sleeve 20 begins to be rotationally driven by the rotation of the pressure roller, and the temperature of the heater 16 has been increased to a preset level, and kept at the preset level, by the electric power supplied to the heater 16, that a sheet P of recording medium begins to be conveyed through the nip N while remaining pinched between the pressure roller 22 and fixation sleeve 20. That is, a sheet P of recording medium, by which an unfixed toner image is borne, is introduced between the fixation sleeve 20 and pressure roller 22, in the nip N, while being guided by an entrance guide 23. Then, the sheet P is moved with the fixation sleeve 20 through the nip N, with the toner image bearing surface of the sheet P being kept in contact with the outward surface of the fixation sleeve 20.

While the sheet P of recording medium is conveyed through the nip N, the heat from the heater 16 is given to the sheet P through the fixation sleeve 20. Consequently, the unfixed toner image on the sheet P is welded (fixed) to the sheet P by the heat and pressure applied thereto in the nip N. After being conveyed through the nip N, the sheet P is separated from the fixation sleeve 20 by the curvature of the fixation sleeve 20. Then, it is discharged from the fixing device 12 by a discharge roller 26 of the fixing device 12.

Incidentally, referential codes 23 and 26 stand for the entrance guide and discharge roller, respectively, attached to the frame 24 of the fixing device 12. The entrance guide 23 plays the role of accurately guiding the sheet P after the sheet P is conveyed through the secondary transfer nip. The material for the entrance guide 23 in this embodiment is polyphenylenesulfide (PPS) resin. In this embodiment, the distance from the secondary transfer nip to the fixation nip N is 100 mm.

2) Parallelly Disposed Two Heat Generating Resistors

Figure 4:
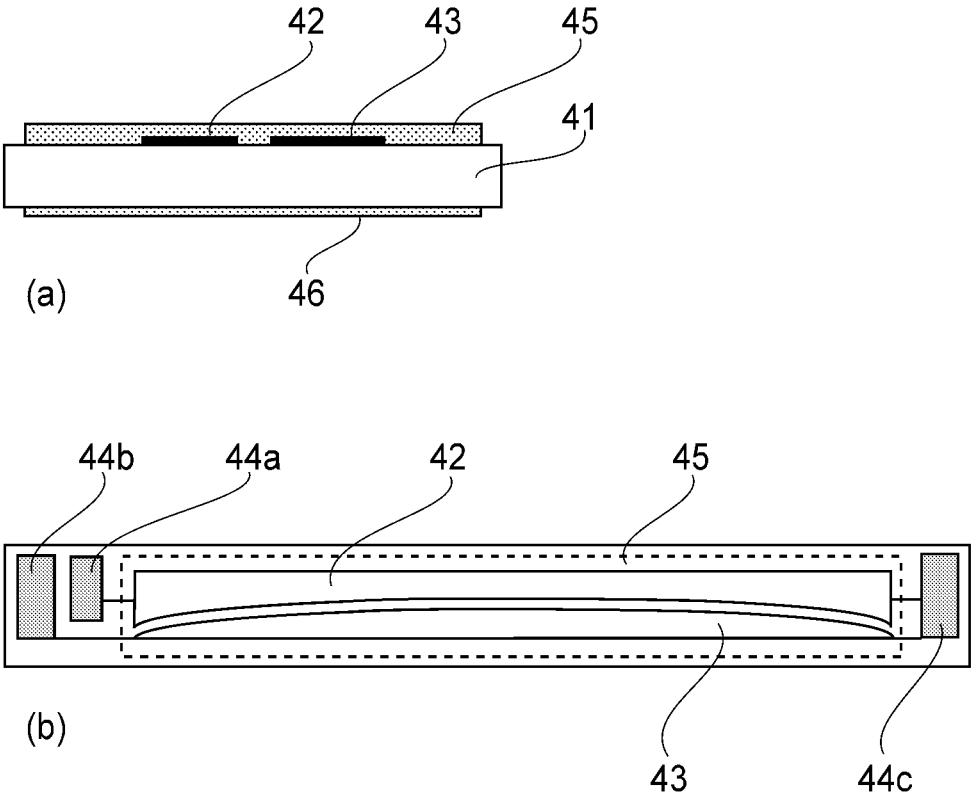
FIGS. 4(*a*) and 4(*b*) are schematic sectional and plan view of the fixation heater in the first embodiment.

FIGS. 4(*a*) and 4(*b*) are schematic sectional and plan views, respectively, of the heater 16. The heater 16 is provided with multiple (two) heat generating resistors. More concretely, it is provided with first and second heat generating resistors, which are disposed in parallel so that when they are in the hollow of the fixation sleeve 20, they are perpendicular to the recording medium conveyance direction, and also, so that they can be independently supplied with electric power from each other. The first heat generating resistor is structured so that its lengthwise end portions are smaller in the amount of heat generation than its center portion, whereas the second heat generating resistor is structured so that its lengthwise end portions are greater in the amount of heat generation than its center portion.

The heater 16 is made up of a substrate 41 and a pair of heat generating resistor layers 42 and 43 (first and second heat generating resistors). The substrate 41 is in the form of a long and narrow rectangular plate. It is formed of ceramic. In this embodiment, the substrate 41 is 370 mm in length, 10 mm in width, and 0.6 mm in thickness. The heat generating resistor layers 42 and 43 are on one of the primary surfaces of the substrate 41. They extend in the lengthwise direction of the substrate 41. They are roughly 10 μm in thickness, roughly 1 mm in width (dimension in terms of recording medium conveyance direction), and roughly 303 mm in length). Their material is silver/palladium (Ag/Pd). They are formed by drawing fine lines or narrow stripes on one of the primary surface of the substrate 41, with electrically conductive paste which contains silver and paradigm, by screen printing. They generate heat as electric current is flowed through them.

The heater 16 is also provided with electrodes 44*a*, 44*b*, and 44*c* formed of silver paste or the like, in a preset pattern, on the substrate 41, by screen printing, to supply the heat generating resistors 42 and 43 with electric power. Further, the heater 16 is provided with a thin glass coat 45 for protecting and insulating the heat generating resistors 42 and 43. The glass coat 45 is roughly 30 μm in thickness. Moreover, the heater 16 is provided with a low-friction layer 46, which is on the opposite surface of the substrate 41 from where the heat generating resistors are located, so that the low-friction layer 46 contacts the inward surface of the fixation sleeve 20.

Referring to FIG. 4, the electrodes 44 (44*a*, 44*b* and 44*c*) of the heater 16 are fitted with power supply connector, through which electric power is supplied to the electrodes 44 from the heater driving circuit 21, which will be described later. As electric power is supplied to the electrodes 44, the heat generating resistors 42 and 43 generate heat, and the heater 16 quickly increases in temperature. In this embodiment, the electrode 44*c* is a common electrode. Thus, it is through the electrodes 44*a* and 44*b* that electric power is supplied to the heater 16 to cause the heat generating resistors 42 and 43, respectively, to generate heat. Thus, the heat generating resistors 42 and 43 can be independently driven from each other.

In this embodiment, the two heat generating resistors 42 and 43 are different from each other, in heat generation pattern in terms of the lengthwise direction. More specifically, the heat generating resistor 42 is such that its lengthwise end portions are smaller in the amount of heat generation than its lengthwise center portion, whereas the heat generating resistor 43 is such that its lengthwise end portions are greater in the amount of heat generation than its lengthwise center portion.

Figure 5:
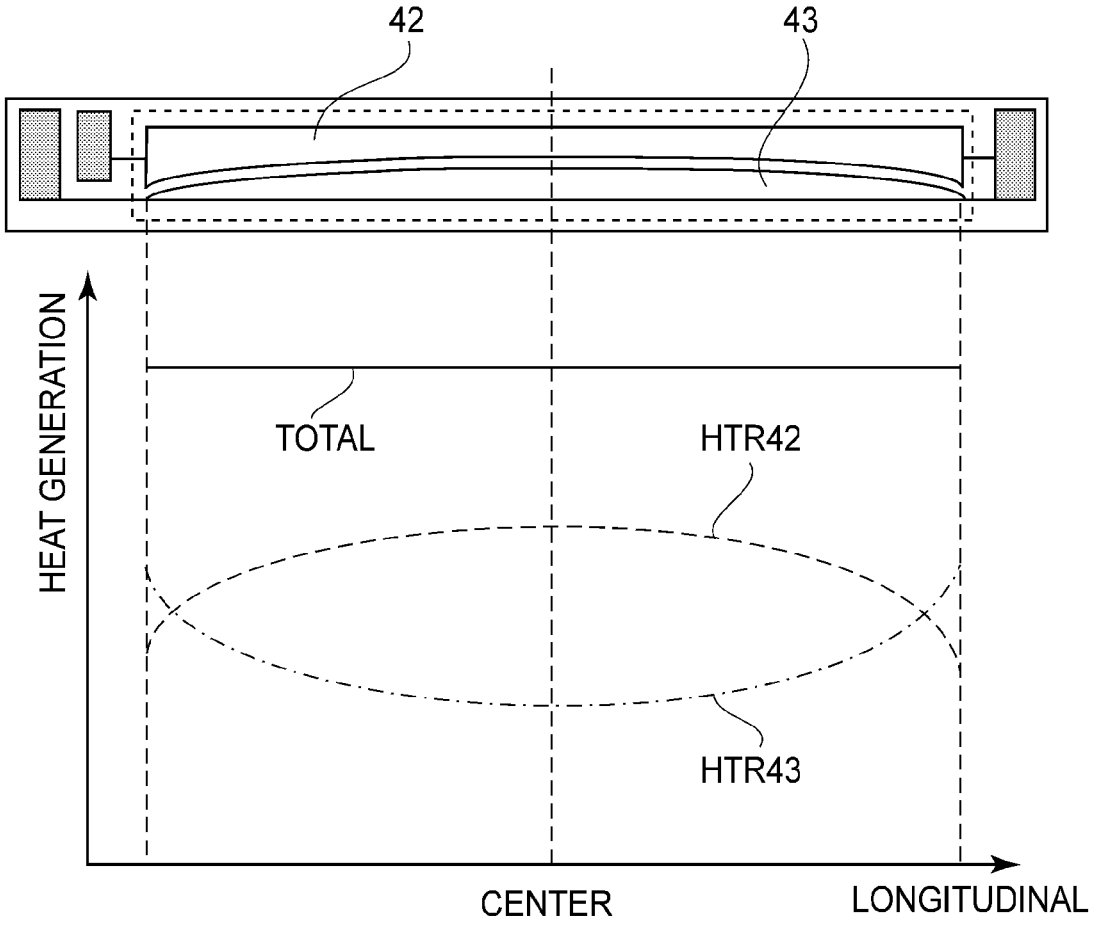
FIG. 5 is a drawing for showing the heat generation pattern of the fixation heater in the first embodiment, in terms of the lengthwise direction of the heater.

FIG. 5 shows the heat generation pattern of each of the heat generating resistors 42 and 43 in terms of the lengthwise direction, and heat generation pattern of the heater 16 (combination of the heat generating resistors 42 and 43) in terms of the lengthwise direction. In this embodiment, the design of the heater 16 is such that when the electric power supplied to the heat generating resistor 42 is the same in voltage and duty cycle as the electric power supplied to the heat generating resistor 43, the heater 16 (combination of heat generating resistors 42 and 43) is uniform in heat generation (flat in heat generation pattern in FIG. 5). The heat generating resistors 42 and 43 are 15Ω and 23Ω, respectively, in electrical resistance, and 960 W and 630 W, respectively, in maximum amount of heat generation, when the electric power supplied thereto is 120 V in voltage.

Figure 6:
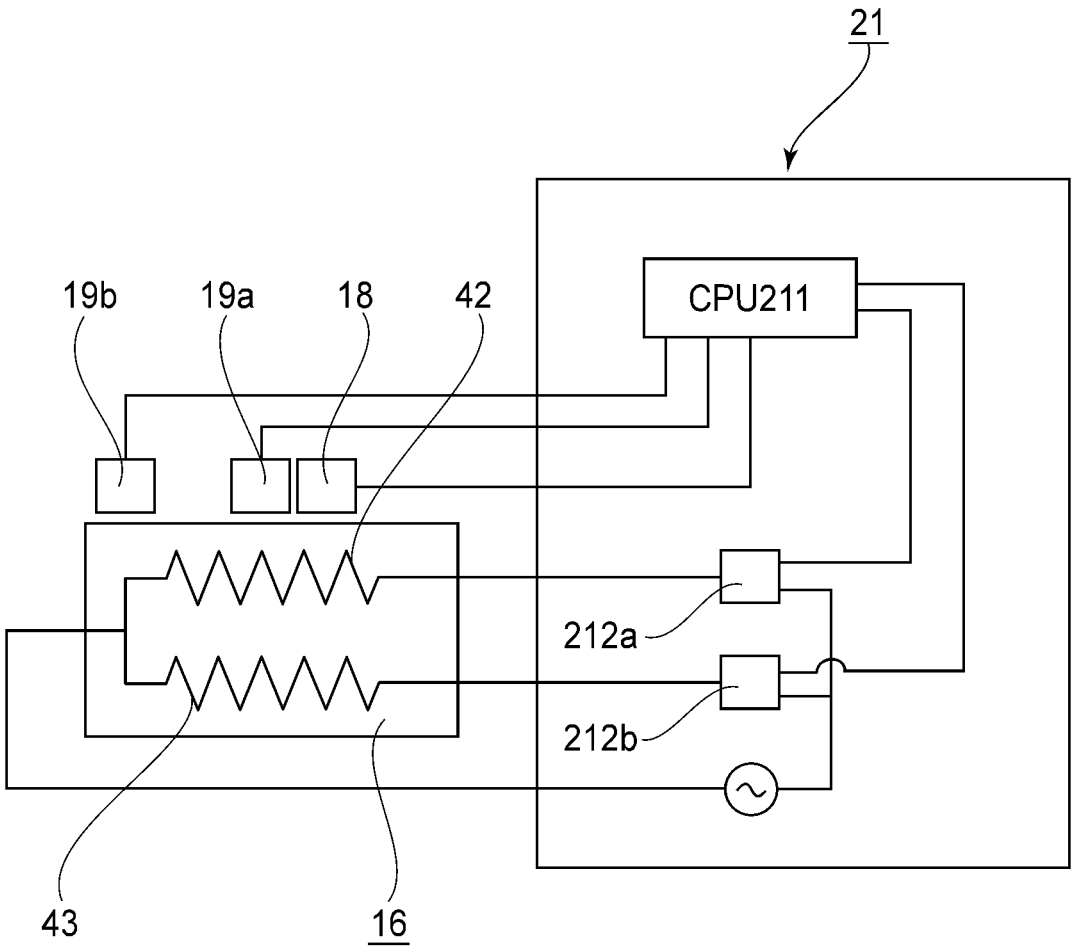
FIG. 6 is a schematic drawing of the fixation heater driving circuit in the first embodiment.
Figure 9:
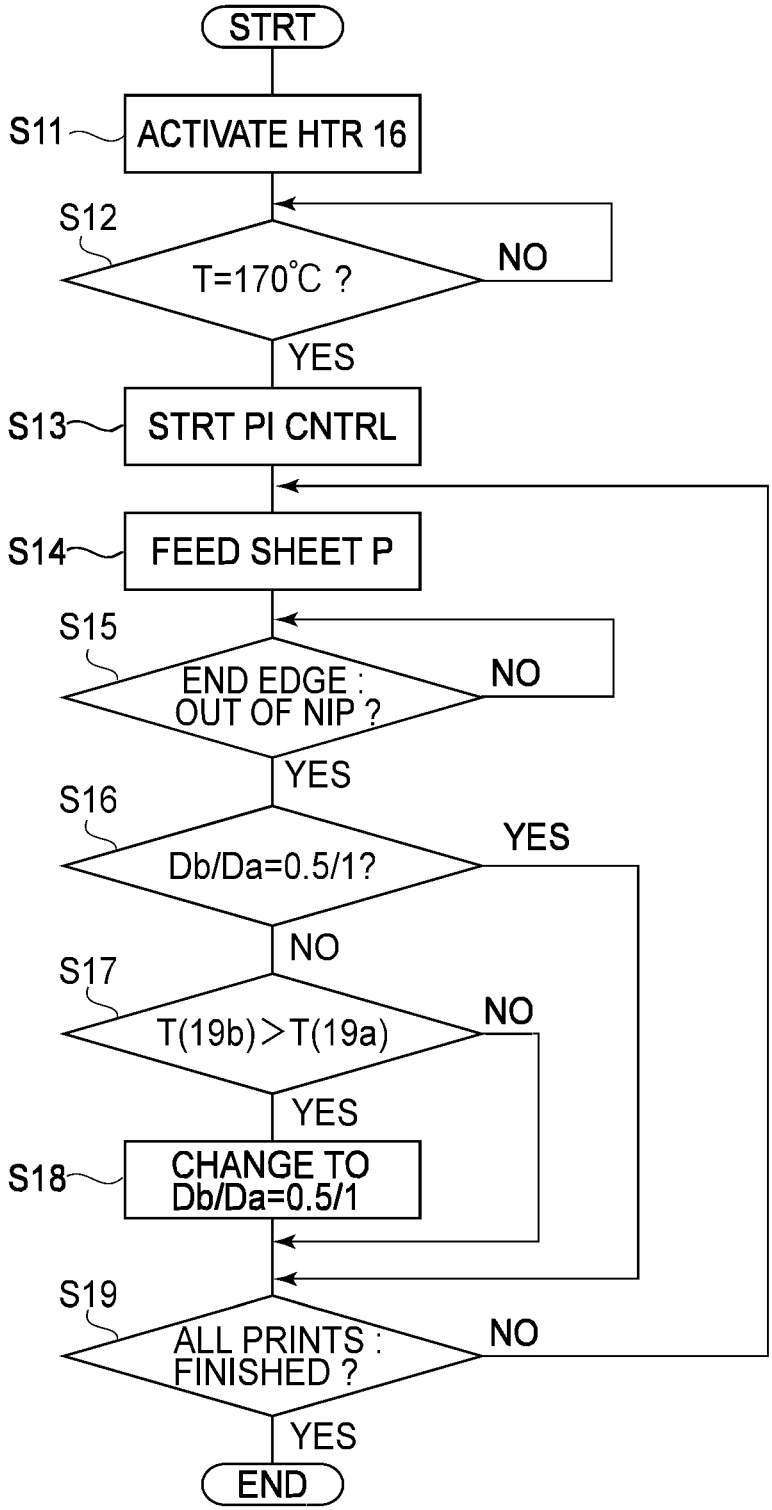
FIG. 9 is a flowchart of the heater drive control in the first embodiment.

3) Heater Driving Circuit and Method for Controlling Heater in Amount of Heat Generation Next, referring to FIGS. 6 and 9, the details of the heater driving circuit 21 and the method for controlling the heater 21 in the amount of heat generation are described. By the way, in the following description of the embodiments of the present invention, "power supply duty (power supply duty cycle)" means the length of time electric power is actually supplied per unit length of time. "Power supply duty ratio" means the ratio of the duty cycle of the electric power supplied to one of the multiple heat generating resistors of a heater, relative to that of another heat generating resistor. For example, in a case where a heater has two heat generating resistors A and B, which are Da and Db in power supply duty, the power supply duty ratio of the heat generating resistor B, relative to that of the heat generating resistor A is Db/Da.

Referring to FIG. 6, the heater driving circuit 21 is an example of circuit for controlling the power supply to the heater 16. As the temperature information obtained by the thermistors 18 and 19 is inputted into the CPU 211, the CPU 211 controls the triacs 212*a* and 212*b* in power delivery timing, in order to keep the temperature of the heater 16 (fixation sleeve 20) at a preset level, based on the results of temperature detection by the thermistors 18 and 19. The triac 212*a* is in connection to the heat generating resistor 42 through the electrode 44*a*, whereas the triac 212 *b* is in connection to the heat generating resistor 43 through the electrode 44*b*.

Therefore, the CPU 211 can individually control the triacs 212*a* and 212*b* in power supply duty ratios Da and Db, respectively, and therefore, can control the heater 16 in heat generation pattern in terms of the lengthwise direction. The method for controlling the triacs 212*a* and 212*b* in terms of the power supply duties Da and Db, respectively, is described later in detail.

Figure 7:
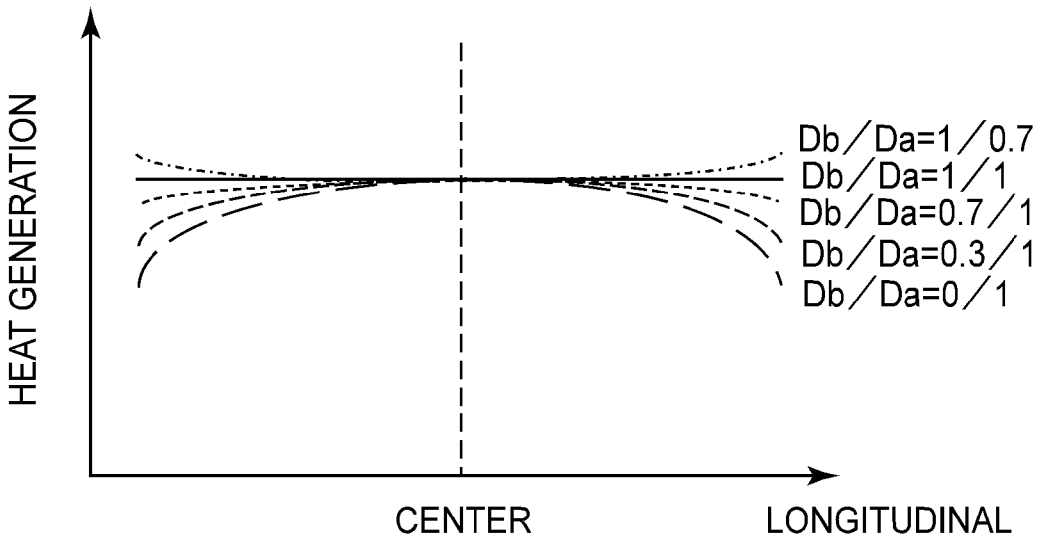
FIG. 7 is a drawing which shows the heat generation pattern of the fixation heater in the first embodiment, in terms of the lengthwise direction of the heater.

By connecting the heater 16 to the heater driving circuit 21, and controlling the triacs 212*a* and 212*b* in power duty ratio Db/Da, it is possible to make the heat generation pattern of the heater 16, in terms of the lengthwise direction, have a desired gradient. FIG. 7 shows examples of the heat generation pattern of the heater 16, in terms of the lengthwise direction, which reflect power supply duty ratio.

In this embodiment, in a case where the power supply duty ratio Db/Da is one (Db/Da=1/1), the heat generation pattern in the lengthwise direction is flat. In comparison, in a case where Db/Da<1, for example, Db/Da=0.7/1, the heat generation pattern in terms of the lengthwise direction, becomes higher across the center portion (shaped like mountain), where as in a case where Db/Da>1, for example, Db/Da=1/0.7, the heat generation pattern becomes higher across the lengthwise end portions (shaped like valley).

In this embodiment, the power supply duty ratio of the heat generating resistor 43, relative to the heat generating resistor 42, that is, Db/Da, can be switched as shown in Table 1 according to the size of a sheet P of recording medium. That is, in a case where a sheet P of recording medium of size A3, or the widest sheet P of recording medium conveyable through the fixing device 12, is conveyed through the fixing device 12, it is possible to set the power supply duty ratio Db/Da to one (Db/Da=1/1) to make the heater 16 flat in heat generation pattern in the lengthwise direction, in order to make the entirety of the path of the sheet P of size A3 uniform in fixation.

On the other hand, in a case where a small sheet P of recording medium, for example, a sheet P of recording medium of the letter size, the width of which is less than that of the widest sheet P of recording medium conveyable through the fixing device 12, is conveyed in the portrait attitude through the fixing device 12, it is possible to set the power supply duty ratio Db/Da to 0.5 (Db/Da=0.5/1 to reduce the heat generating resistor 43 in the amount of heat generation, in order to reduce in the amount of heat generation, the portions of the recording medium passage, through which a sheet P of recording medium of letter size, does not pass. By doing so, it is possible to minimize the unnecessary temperature increase across the out-of-sheet-path portions.

TABLE 1

| Ratio Db/Da | Sheet size |
|---|---|
| 1/1 | 290-300 mm (A3 Portrait, A4 Landscape) |
| 0.5/1 | 268-289 mm (Ledger Portrait, Letter Landscape |

Next, referring to FIG. 9 (flowchart), the method for controlling the heater driving circuit 21 in this embodiment is described. FIG. 9 (flowchart) is related to a case where multiple sheets of recording medium of the letter size are continuously conveyed in the portrait attitude through the fixing device 12.

As a print command for a given printing job is inputted into the image forming apparatus, electric power begins to be supplied to the heater 16 in synchronism with the starting of the driving of the fixing device 12 (S11). During the warm-up period, the triacs 212*a* and 212*b* are controlled so that the power supply duty ratio Db/Da remains to be 1 (Db/Da=1/1, Da=100%, Db=100%).

"Target temperature" means a temperature level to be set as the desired peripheral surface temperature level for the fixation sleeve 20 when the fixing device 12 is used for thermal fixation. "Warm-up period" means the period from when electric power begins to be supplied to the heat generating resistor 42 and/or 43 to when the first sheet P of recording medium, on which an unfixed toner image is present, begins to be conveyed to the fixation nip N.

By setting the power supply duties Da and Db to 100% during the warm-up period, it is possible to make the heat generating resistors 42 and 43 generate heat at their highest capacity. Therefore, it is possible to increase the heater 16 (film 36) in temperature as fast as possible. As the temperature detected by the thermistor 18 reaches 170° C. (S12), an initial offset value, which will be described later, is set to 40%, and PI control is started (S13).

Then, sheets P of recording medium begin to be fed in S14. The timing with which the sheets P begin to be fed may be before the starting of the PI control (S13), as long as it is ensured that the unfixed toner image on the sheet P is satisfactorily fixed. As the trailing edge of the first sheet P comes out of the nip N (S15), it is checked whether or not the power supply duty ratio Db/Da has been switched to 0.5/1 (S16). If the power supply duty ratio Db/Da has not been switched in S16, the CPU compares the temperature detected by the thermistor 19*a* with the temperature detected by the heater end thermistor 19*b* (S17).

If the temperature detected by the thermistor 19*b* is higher, the CPU 211 switches the power supply duty ratio Db/Da to 0.5/1 while sheets P of recording medium which are the same in size in terms of the lengthwise direction are conveyed for thermal image fixation (S18). By switching the power supply duty ratio Db/Da to 0.5/1 in this way, it is possible to minimize the amount by which the out-of-sheet-path portions of the heater 16 (fixation sleeve 20) increase in temperature while the sheets P of recording medium which are the same in size in terms of the lengthwise direction are conveyed for thermal fixation through the fixing device 12. On the other hand, if it is determined in S16 that the power supply duty ratio Db/Da has already been switched to 0.5/1, Steps S16 and S17 are skipped.

If it is determined in S19 that the printing job has not been completed, the CPU 211 repeats Steps S14-S18. If it is determined in S19 that the print job has been completed, the CPU 211 stops controlling.

Next, the method in this embodiment for determining the proper value for power supply duty Da for the triac 212*a*, and the proper value for the power supply duty Db for the triac 212*b*, is described in comparison to a comparative method.

1) Comparative Method (Conventional Method)

First, an interim power supply duty D for the heater 16 is determined with the use of the so-called PI control, which is a combination of proportional control (P) and integral control (I). D is defined by the following equation:

$$D = \text{Proportional Control Component} + \text{Integral Control Component} + \text{Initial Offset Value} \quad \text{(Formula 1)}$$

Figure 8:
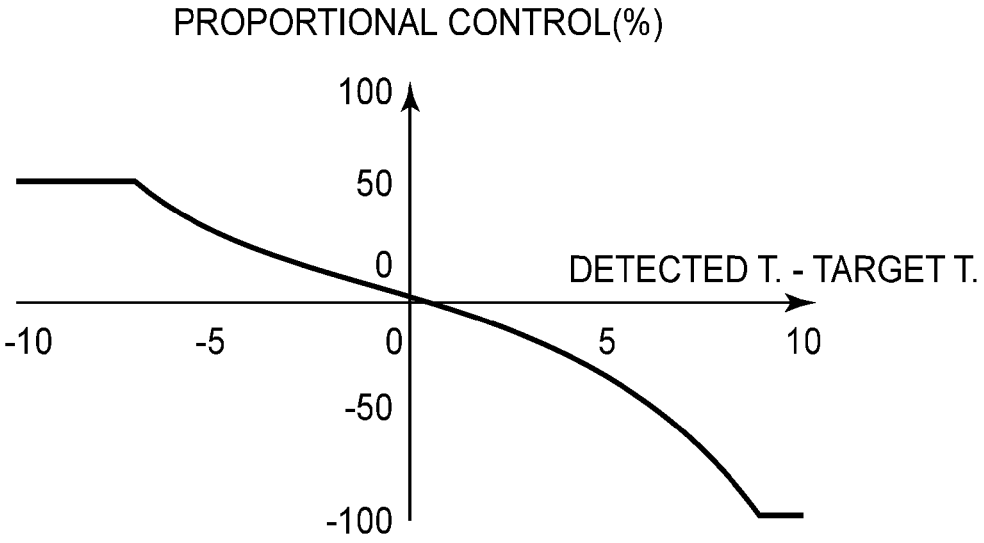
FIG. 8 is a drawing which shows the proportional control component of the PI control in the first embodiment.

The proportional control component is set every 20 ms based on the value of ΔT (=detected temperature level·target temperature level) with reference to FIG. 8 (graph). As for the integral control component, it is set every 20 ms based on ΣΔT, which is the sum of ΔT. That is, the integral control component is increased by 1.0% as ΣΔT becomes greater than 36 (ΣΔT>36), and decreased by 1.0% as ΣΔT becomes smaller than −60 (ΣΔT<−60).

The initial offset value is provided for ensuring that the temperature of the heater 16 (fixation sleeve 20) is reliably controlled during the initial stage of the PI control. It is to be optimally set to prevent the temperature detected by the thermistor 28 from overshooting or undershooting the target temperature. In this embodiment, the initial offset value is 40%.

The power supply duty Da for the triac 212*a* and the power supply duty Db for the triac 212*b*, are set with the use of the following formulas, and the interim power supply duty D is set as described above. That is, the relationship between the temperature detected by the thermistor 18 and the power supply duty for the heat generating resistors 42 and 43 are preset. Therefore, the values therefor are selected according to the detected temperature.

$$Da = D \times \alpha \quad \text{(Formula 2)}$$

$$Db = D \times \beta \quad \text{(Formula 3)}$$

α and β stand for the values of the Db and Da, respectively. They are no less than 0, and no more than 1. If α>β, α=1. If α<β, β=1. Further, if α=β, α=β=1.

Table 2 shows the results of comparison between the amount of heat generation by the heater 16 before the power supply duty ratio was switched, and the amount of heat generation by the heater 16 after the power supply duty ratio was switched, while a substantial number of sheets P of recording medium which were the same in size were continuously conveyed, more specifically, a substantial number of sheets P of recording medium of the letter size, were continuously conveyed in portrait attitude (120 V). Immediately after the switching of the power supply duty ratio Db/Da from 1/1 to 1/0.5, the power supply duty for the heat generating resistor 43 reduces from 55% to 28%. Since the maximum amount of heat generation of the heat generating resistor 43 is 630 W, the amount of heat generation of the heat generating resistor 43 reduces from 344 W (630 W×55%) to 172 W (=630 W×28%).

Figure 12:
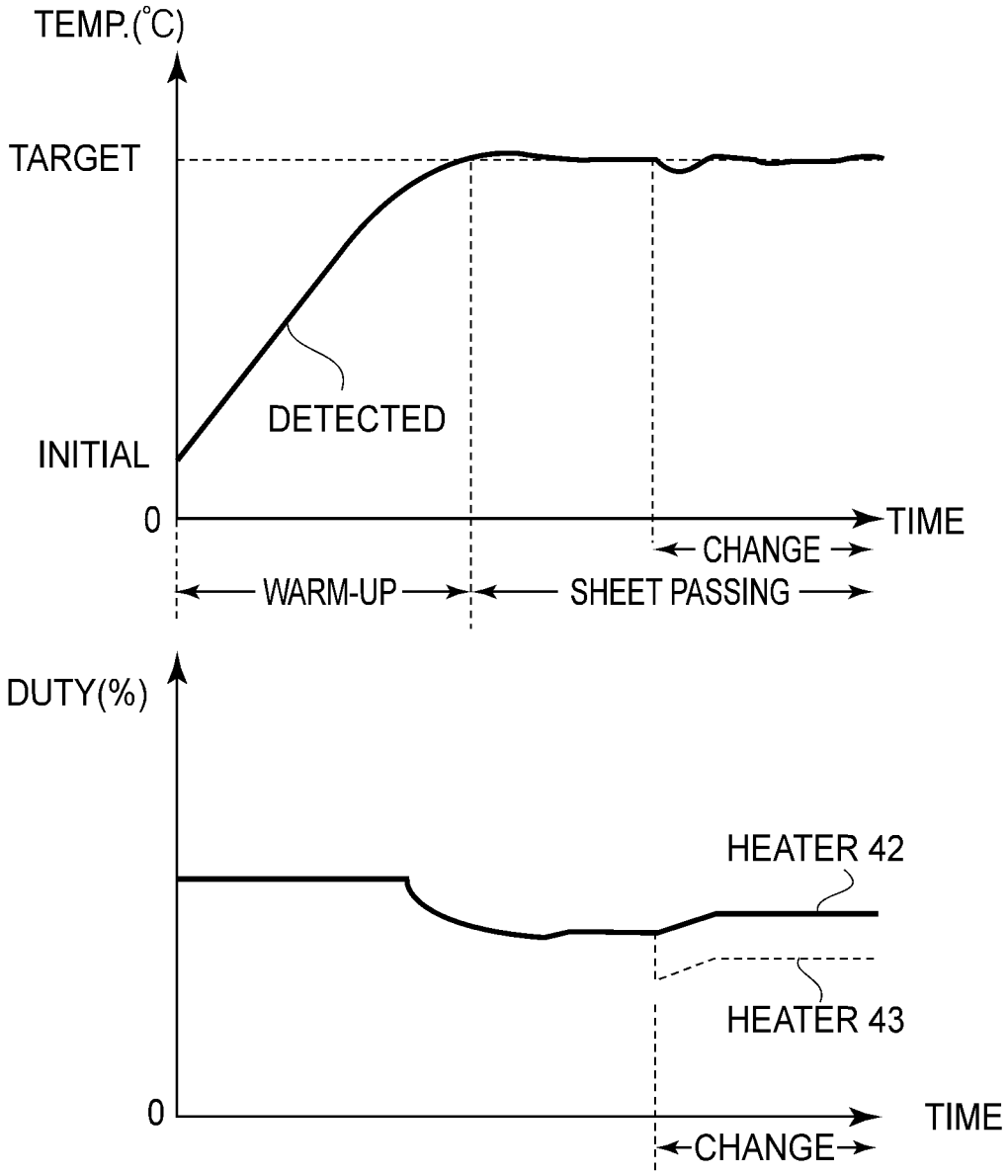
FIG. 12 is a drawing which shows the temperature and power supply duty before and after the switching of the power supply duty ratio, in the conventional fixation heater drive control.

In comparison, in the case of the comparative method, the power supply duty of the heat generating resistor 42 is not changed. Thus, the amount of heat generation of the heat generating resistor 42 remains to be 528 W (=960 W (maximum amount of heat generation of heat generating resistor 42)×55%). Therefore, the sum of the amount of heat generation of the heat generating resistor 42 and the amount of heat generation of the heat generating resistor 43 reduced from 872 W to 700 W. Thus, the amount of heat generation by the heater 16 is insufficient to keep the temperature detected by the thermistor 18 at the target level. That is, the temperature of the fixation sleeve 20 fell below its target level (FIG. 12), making it possible for an unfixed toner image to be unsatisfactorily fixed to a sheet P of recording medium.

A phenomenon such as the above described one is likely to occur in a case where the distance between a temperature detection element used for temperature control and a heat generating resistor is relatively large, or the heater substrate is relatively large in thermal resistance. For example, the phenomenon is likely to occur in a case where a fixing device is of the heating film type, like the one in this embodiment, and the temperature detection element is placed on the outward or inward surface of the fixation sleeve, instead of one of the surfaces of the heater, to control the fixation film in temperature. This kind of structural arrangement has merit that the fixation film can be more precisely controlled in temperature. On the other hand, it has demerit that it takes longer to detect the heater temperature reduction attributable to the reduction in the amount of heat generation of the heater 16, and therefore, it is likely for the heater temperature to fall below the target level.

TABLE 2

| | Before switching | After switching |
|---|---|---|
| Duty ratio Db/Da | 1/1 | 0.5/1 |
| Temporary Duty ratio (%) | 55 | 55 |
| Power supply duty Da (%) | 55 | 55 |
| Power supply duty Db (%) | 55 | 28 |
| Heat Generation amount by element 42 (W) | 528 | 528 |
| Heat Generation amount by element 43 (W) | 344 | 172 |
| Sum of heat generation amount (W) | 872 | 700 |

2) Controlling Method in this Embodiment

Next, the method, in this embodiment, for preventing the heater 16 from reducing in the amount of heat generation after the switching of power supply duty ratio, in order to prevent the temperature detected by the thermistor 18 from reducing, is described. In terms of the procedure to calculate the value for the interim power supply duty D, the method in this embodiment is the same as the comparative method. However, in this embodiment, the power supply duty Da for the triac 212*a* and the power supply duty Db for the triac 212*b* are set with the use of the following formulas:

$$Da=D\times\alpha\times(R42+R43)/(R43\times\alpha+R42\times\beta) \quad \text{(Formula 4)}$$

$$Db=D\times\beta\times(R42+R43)/(R43\times\alpha+R42\times\beta) \quad \text{(Formula 5)}$$

R42 and R43 are resistance values of the heat generating resistors 42 and 43, respectively. Table 3 shows the comparison between the amount of heat generation by the heater 16 immediately before the power supply duty ratio was switched and the amount of heat generation by the heater 16 immediately after the power supply duty ratio was switched, while a substantial number of sheets P of recording medium which are the same in size were continuously conveyed, more specifically, a substantial number of sheets P of recording medium of the letter size, were continuously conveyed in portrait attitude. In this embodiment, the values for the power supply duties Da and Db are set with the use of Formulas 4 and 5, which are for setting the values for the power supply duties Da and Db to ensure that the overall amount of heat generation of the heater 16 after the switching of the power supply duty ratio Db/Da remains the same as that prior to the switching.

Since (R42+R43)/(R43×α+R42×β) is greater than 1, the relationship between the detected temperature and the power supply duty set according to the detected temperature prior to the switching of the power supply duty ratio is different from that after the switching. That is, in the case of the heat generating resistor 42, the power supply duty (Formula 4) set according to the detected temperature after the switching of the power supply duty ratio is greater than the power supply duty (Formula 2) set according to the detected temperature prior to the switching. Similarly, in the case of the heat generating resistor 43, the power supply duty (Formula 5) set according to the detected temperature after the switching of the power supply duty ratio is greater than the power supply duty (Formula 3) set according to the detected temperature prior to the switching.

That is, in this embodiment, when the power supply duty ratio Db/Da of the heat generating resistor 43 relative to the heat generating resistor 42 is switched, the power supply duty of the heat generating resistor 42 is increased or decreased in the opposite direction from the direction in which the power supply duty of the heat generating resistor 43 is increased or decreased. Therefore, it is possible to keep the temperature of the fixation sleeve 20 at the target level, and therefore, to prevent an unfixed toner image from being unsatisfactorily fixed to a sheet P of recording medium.

TABLE 3

| | Before switching | Conventional Example | After switching |
|---|---|---|---|
| Duty ratio Db/Da | 1/1 | 0.5/1 | 0.5/1 |
| Temprary Duty ratio (%) | 55 | 55 | 55 |
| Power supply duty Da (%) | 55 | 55 | 69 |
| Power supply duty Db (%) | 55 | 28 | 34 |
| Heat Generation amount by element 42 (W) | 528 | 528 | 658 |
| Heat Generation amount by element 43 (W) | 344 | 172 | 214 |
| Sum of heat generation amount (W) | 872 | 700 | 872 |

(Effects of this Embodiment)

According to this embodiment, the multiple (two) heat generating resistors are switched in power supply duty while sheets of recording medium which are the same in size are continuously conveyed through the fixing device 12. Therefore, not only is it possible to minimize the length of time it takes for the fixing device 12 to become ready for image formation after the fixing device 12 is turned on, but also, to minimize the amount of temperature increase of the out-of-sheet-path portions of the heater 16 (fixation sleeve 20). Further, it is possible to prevent (preferably, to keep) the amount by which heat is generated by the heater 16 after the switching of the power supply duty ratio is made while a substantial number of sheets P of recording medium are continuously conveyed through the fixing device 12, from becoming different from (the same as) that prior to the switching. Therefore, it is possible to prevent the temperature of the fixation sleeve 20 from substantially deviating from the target level (and therefore, to prevent occurrence of unsatisfactory fixation).

In particular, this embodiment is effective in a case where unsatisfactory fixation is likely to occur, for example, in a case where an image forming apparatus is high in process speed (Case 1), and in a case where the portion of a fixing device, which is between the heater and heater temperature detecting portion of the fixing device, is high in thermal resistance (Case 2).

Figure 10:
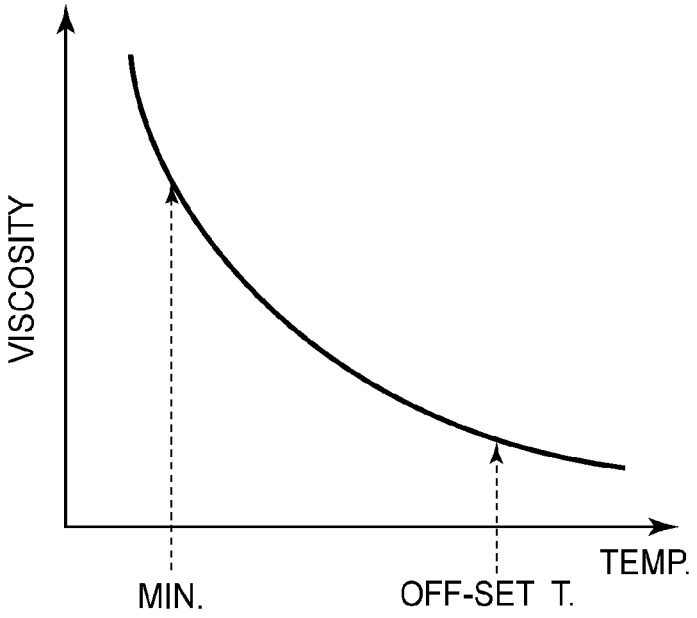
FIG. 10 is a drawing for schematically showing the temperature dependency of the viscosity of melted toner.
Figure 11:
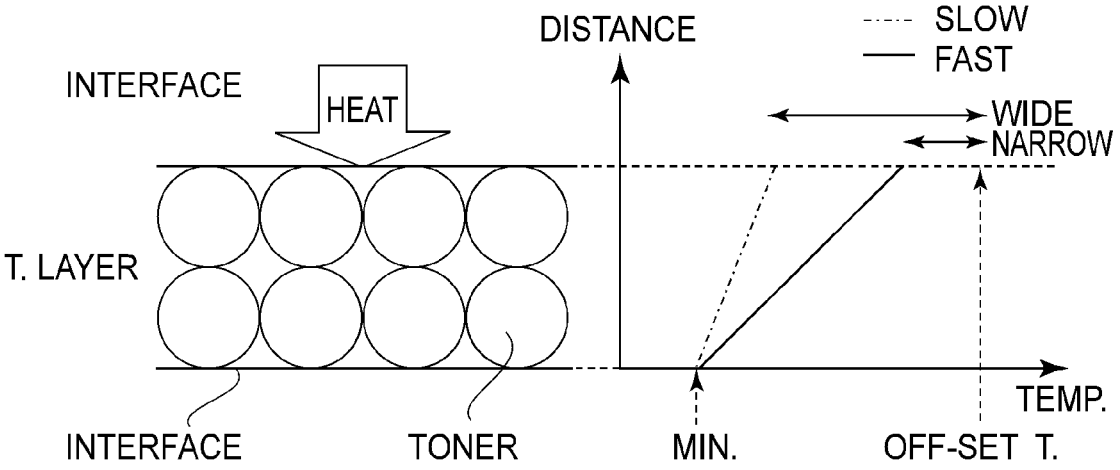
FIG. 11 is a drawing which shows a temperature range in which the target temperature for the fixing device can be set.

Hereafter, referring to FIGS. 10 and 11, first, the reason why unsatisfactory fixation is likely to occur in Case 1 is described. FIG. 10 is a schematic drawing for showing the dependency of the viscosity of melted toner upon temperature. The higher the melted toner in temperature, the lower the melted toner in viscosity, being therefore more likely to unsatisfactorily solidify after its permeation into recording medium. Therefore, the higher the melted toner in temperature, the more likely for the melted toner to offset back onto a fixing member (this phenomenon will be referred to as "hot offset", hereafter). On the other hand, the lower in temperature the melted toner, the higher in viscosity the melted toner, and therefore, the less satisfactory the melted toner in its permeation into recording medium. That is, if the melted toner is excessively low in temperature, it fails to be satisfactorily fixed to recording medium.

FIG. 11 is a drawing for showing the relationship between the desirable temperature range in which the target temperature for image fixation can be set, and the process speed (peripheral velocity of fixation sleeve). The slower the process speed, the greater the amount by which the toner layer can be supplied with heat by the fixation sleeve 20 per unit length of time, and therefore, the gentler the temperature gradient within the toner layer. That is, referring to the left side of FIG. 12, the difference between the temperature of the bottom surface (interface between sheet of recording paper and toner layer) of the toner layer, and the temperature of the top surface (interface between toner layer and fixing member) of the toner layer, is relatively small. Thus, the moment when the temperature of the bottom surface of the toner layer reaches the lowest point in the temperature range in which unsatisfactory fixation does not occur, the temperature of the top surface of the toner layer will have not risen to the level above which hot-offset occurs. That is, there is sufficient margin for preventing hot-offset.

That is, the slower the process speed, the wider the temperature range in which the target temperature can be set, that is, the range which is lower than the temperature level at or above which hot-offset occurs, and higher than the temperature level at or above which the top surface of the toner layer fixes itself to recording medium.

On the other hand, the higher the process speed, the steeper in temperature gradient the toner layer. Thus, the moment when the temperature of the top surface of the toner layer reaches the lowest temperature level at which the toner layer is satisfactorily fixable to the recording medium, is close to the temperature level at or above which hot-offset occurs. That is, there is not enough margin for preventing hot-offset.

In other words, the temperature range in which the target temperature can be set is rather narrow. In this case, it is sometimes impossible to set the target temperature to a level which is lower than the level at or above which hot-offset occur, and is higher than the lowest temperature level for the top surface of the toner layer to be fixed to the recording medium. That is, if the target temperature for the heater 16 (fixation sleeve 20) is set to a level which is lower than the lowest level at which the top surface of the toner layer is fixable to the recording medium, unsatisfactory fixation will occur.

Next, the reason why unsatisfactory fixation is likely to occur in Case 2 is described, with reference to fixing devices which employ a fixation film. Some fixing devices (type A) which employ a fixation film are structured so that their temperature detecting portions are positioned so that they can directly detect the temperature of their heaters, whereas the others (type B) are structured so that their temperature detecting portions are placed in contact with the inward or outward surface of the fixation film. The fixing devices of the type A correspond to the case where the portion of a fixing device, which is between the heater of the device, and the heater temperature detecting portion of the device, is relatively small in thermal resistance, whereas the fixing devices of the type B correspond to the case where the portion is relatively large in thermal resistance.

In the case of the fixing devices of the type A, the reduction in the heater temperature, which occurs as the heater is changed in power supply duty ratio, can be quickly detected. Therefore, the amount by which electric power is supplied to the heater can be instantly increased to minimize the temperature reduction. In comparison, the fixing devices of the type B have merit that they can be more precisely controlled in the temperature of their fixation film than the fixing devices of the type A. However, they require a longer length of time for them to detect the reduction in the temperature of their heaters, which occurs as the electric power to be supplied to the heater is switched in power supply duty ratio, than the fixing devices of the type A. Therefore, it takes longer for them to be increased in the amount by which electric power is supplied to the heater, which in turn makes it likely for the temperature of the heater (fixation film) to become lower than the target temperature. This is why the fixing devices of the type B are more likely to suffer from unsatisfactory fixation than the fixing devices of the type A, after the power supply to the heater is switched in duty ratio.

According to this embodiment, it is possible to prevent the occurrence of unsatisfactory fixation, even if the process speed is relatively high and/or the portion of a fixing device, which is between the heater and temperature detecting portion of the fixing device is relatively large in thermal resistance.

(Modification 1)

In the above-described embodiment, the heat generating resistor 42 was such that in terms of the lengthwise direction, its center portion is greater in the amount of heat generation than its center portion, whereas the heat generating resistor 43 was such that in terms of the lengthwise direction, its lengthwise end portions are greater in the amount of heat generation than its center portion. That is, the first and second heat generating resistors 42 and 43 may be similar in characteristic in terms of the heat generation pattern in terms of the lengthwise direction, which is perpendicular to the recording medium conveyance. Further, the first heat generating resistor 42 may be flat (uniform) in the heat generation pattern in terms of the lengthwise direction, which is perpendicular to the recording medium conveyance direction.

Incidentally, in terms of electrical connection, the heat generating resistors 42 and 43, which are disposed parallel in tandem in the recording medium conveyance direction may be connected in parallel or in series.

(Modification 2)

In the above-described embodiment, the number of choices to which the power supply duty of each heat generating resistor can be switched during a printing operation was limited to only two. However, the embodiment is not intended to limit the present invention in terms of the number of power supply duty choices. That is, the present invention is also applicable to fixing devices provided with three or more choices of power supply duty for their heat generating resistors, which can be selected in steps. Also in this embodiment, the heater 16 was structured so that the heat generation pattern of its heat generating resistors 42 and 43 has a smooth curvature in terms of the lengthwise direction. However, the present invention is also compatible with a heater, the heat generation pattern of the heat generation resistors of which is stair-stepped in terms of the lengthwise direction.

(Modification 3)

Also in the above-described first embodiment, the timing with which the power supply duty ratio Db/Da was switched was the same as the timing with which the power supply duties Da and Db were switched. However, the timing with which the power supply duty Da is switched dos not need to be the same as the timing with which the power supply duty Db is switched. That is, the power supply duty Db may be switched after the switching of the power supply duty Da. In other words, the fixing device may be structured so that the timing with which the first heat generating resistor is increased or decreased in power supply duty comes before the timing with which the second heat generating resistor is switched in power supply duty.

Instead, it may be after the switching of the power supply duty Db that the power supply duty Db is switched. In other words, the fixing device may be structured so that the timing with which the second heat generating resistor is increased or decreased in power supply duty comes before the timing with which the first heat generating resistor is increased or decreased in power supply duty.

(Modification 4)

Further in the above-described first embodiment, the power supply duty ratio Db/Da was switched so that it became smaller. However, the present invention is also applicable to a case where the power supply duty ratio is switched so that it becomes larger. Conventionally, switching the power supply duty ratio Db/Da so that it becomes larger resulted in increase in power consumption, which in turn caused the following problems. That is, fixation sleeve temperature exceeded the target temperature level. Therefore, it was possible that "hot-offset" would occur, that is, a part of the melted toner would adhere to the surface of rotational heating member, which would result in the contamination of the following sheets of recording medium.

Even in such a case as those described above, application of the present invention can prevent the occurrence of high temperature offset (hot-offset), which will possibly occur during the switching of power supply duty ratio.

(Modification 5)

Also in the first embodiment described above, the heat generation pattern of the combination of the heat generating resistors 42 and 43 was roughly flat. However, the embodiment is not intended to limit the present invention in terms of the heat generation pattern of the combination. That is, the present invention is also compatible with a heater (16) which generates more heat across its lengthwise end portions than its center portion. Incidentally, also in the case of such a heater, it is desired that the heat generation pattern of the heater (combined heat generation amount of heat generating resistors) after the switching of power supply duty ratio remains the same as that before the switching.

(Modification 6)

Also in the above described first embodiment, the heater (fixation sleeve) temperature was controlled based on the results of the indirect detection of the heater temperature. However, the first embodiment is not intended to limit the present invention in terms of the method for detecting heater temperature. That is, the present invention is also applicable to a fixing device which controls heater temperature based on the results of direct detection of heater temperature with the use of a thermistor.

By the way, in the first embodiment, power supply duty was used as the parameter for controlling the electric power to be supplied to the heater. However, the first embodiment is not intended to limit the present invention in terms of the parameter for controlling the power supply to the heater. That is, any parameter may be used as long as it is correlated to the amount of power supply to the heater per unit length of time. Further, in this embodiment, power supply duty ratio was used as the parameter for switching the heater in heat generation pattern. However, any parameter may be used in place of power supply duty ratio, as long as it is correlated to the ratio of the amount of electric power supplied to one of the heat generating resistor, relative to that of the other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 171154/2013 filed Aug. 21, 2013, which is hereby incorporated by reference.

What is claimed is:

1. An image forming apparatus comprising:

an image forming portion configured to form a toner image on a recording material; and an image heating device configured to heat the recording material having the toner image formed thereon while conveying the recording material, in a nip; and said image heating device including:

a rotatable member;

a plurality of heat generating elements including a first heat generating element and a second heat generating element configured to heat said rotatable member, said heat generating elements extending in a longitudinal direction of said rotatable member, wherein the ratio of a heat generation amount of said second heat generating element at an end portion thereof to that at a central portion thereof with respect to the longitudinal direction is larger than the ratio of a heat generation amount of said first heat generating element at an end portion thereof to that at a central portion thereof with respect to the longitudinal direction;

a back-up member contacting said rotatable member to form the nip;

a temperature detecting portion configured to detect the temperature of said rotatable member or said heater, and a controller configured to control the electric power supplied to said heater in accordance with the detected temperature detected by said temperature detecting portion, said controller being configured to control the electric power supplied to said first heat generating element and the electric power supplied to said second heat generating element, independently from each other, wherein said controller switches the ratio of the electric power supplied to said second heat generating element to the electric power supplied to said first heat generating element from a first ratio to a second ratio, which is smaller than the first ratio, while small size recording materials are being conveyed through said image heating device, the small size recording materials having the same size, and wherein the electric power supplied to said first heat generating element in the second ratio is larger than that in the first ratio at a timing of the switching from the first ratio to the second ratio, and the electric power supplied to said second heat generating element in the second ratio is smaller than that in the first ratio at the timing of the switching.

2. The image heating apparatus according to claim 1, wherein a resistance value per unit length of said first heat generating element in the longitudinal direction is larger in the central portion than in the end portion.

3. The image heating apparatus according to claim 1, wherein a resistance value per unit length of said second heat generating element in the longitudinal direction is smaller in the central portion than in the end portion.

4. The image heating apparatus according to claim 1, wherein the sum of the electric power supplied to said first heat generating element and the electric power supplied to said second heat generating element in the second ratio is the same as that in the first ratio at the timing of the switching.

5. The image heating apparatus according to claim 1, wherein said rotatable member includes a cylindrical film.

6. The image heating apparatus according to claim 5, wherein said heater includes a substrate on which said first heat generating element and said second heat generating element are formed, said first heat generating element and said second heat generating element being juxtaposed in a conveyance direction of the recording material and extending in the longitudinal direction on the substrate.

7. The image heating apparatus according to claim 6, wherein said heater contacts an inner surface of said film.

8. The image heating apparatus according to claim 7, wherein said heater cooperates with said back-up member to form the nip with said film interposed therebetween.

9. The image heating apparatus according to claim 6, wherein said temperature detecting portion detects a temperature of said heater.

10. The image heating apparatus according to claim 1, wherein said temperature detecting portion detects a temperature of said rotatable member.

11. An image forming apparatus comprising:

an image forming portion configured to form a toner image on a recording material; and an image heating device configured to heat the recording material having the toner image formed thereon while conveying the recording material, in a nip; and said image heating device including:

a rotatable member;

a plurality of heat generating elements including a first heat generating element and a second heat generating element, configured to heat said rotatable member, said heat generating elements extending in a longitudinal direction of said rotatable member, wherein the ratio of a heat generation amount of said second heat generating element at an end portion thereof to that at a central portion thereof with respect to the longitudinal direction is larger than the ratio of a heat generation amount of said first heat generating element at an end portion thereof to that at a central portion thereof with respect to the longitudinal direction;

a back-up member contacting said rotatable member to form the nip;

a temperature detecting portion configured to detect the temperature of said rotatable member or said heater; and a controller configured to control electric power supplied to said heater so that the detected temperature detected by said temperature detecting portion is at a target temperature, and said controller is configured to control the electric power supplied to said first heat generating element and the electric power supplied to said second heat generating element, independently from each other, wherein said controller switches the ratio of the electric power supplied to said second heat generating element to the electric power supplied to said first heat generating element from a first ratio to a second ratio, which is smaller than the first ratio, while small size recording materials are being conveyed through said image heating device, the small size recording materials having the same size, and wherein said controller controls said heater so that the sum of the electric power supplied to said first heat generating element and the electric power supplied to said second heat generating element in the second ratio is the same as the sum in the first ratio at the timing of the switching.

12. An image forming apparatus comprising:

an image forming portion configured to form a toner image on a recording material; and an image heating device configured to heat the recording material having the toner image formed thereon while conveying the recording material, in a nip; and said image heating device including:

a rotatable member;

a plurality of heat generating elements including a first heat generating element and a second heat generating element, configured to heat said rotatable member, said heat generating elements extending in a longitudinal direction of said rotatable member, wherein the ratio of a heat generation amount of said second heat generating element at an end portion thereof to that at a central portion thereof with respect to the longitudinal direction is larger than the ratio of a heat generation amount of said first heat generating element at an end portion thereof to that at a central portion thereof with respect to the longitudinal direction;

a back-up member contacting said rotatable member to form the nip;

a temperature detecting portion configured to detect the temperature of said rotatable member or said heater, and a controller configured to control a duty cycle of an electric power supplied to said heater on the basis of a detected temperature of said temperature detecting portion, said controller being configured to control the duty cycle for said first heat generating element and the duty cycle for said second heat generating element, independently from each other, wherein said controller switches the ratio of the electric power supply duty cycle of said second heat generating element to the duty cycle of said first heat generating element from a first ratio to a second ratio, which is smaller than the first ratio, while small size recording materials are being conveyed through said image heating device, the small size recording materials having the same size, and wherein the duty cycle relative to the detected temperature of said first heat generating element in the second ratio is larger than that in the first ratio.

13. The image heating apparatus according to claim 12, wherein the duty cycle relative to the detected temperature of said second heat generating element in the second ratio is smaller than that in the first ratio.

* * * * *